United States Patent [19]

Rainville

[11] 4,068,315

[45] Jan. 17, 1978

[54] MULTI-LAYERED GARMENT FOR THE LOWER BODY

[76] Inventor: Lucien G. Rainville, 2057 - 31 Jasmine Crescent, Ottawa, Ontario, Canada

[21] Appl. No.: 738,964

[22] Filed: Nov. 4, 1976

[51] Int. Cl.[2] ..... A41B 9/00

[52] U.S. Cl. ..... 2/114; 2/243 B

[58] Field of Search ..... 2/114, 83, 212, 213, 2/301, 243 B, 80, 82, 86, 77, 72, 220; 128/524, 529, 543, 561, 562

[56] References Cited

U.S. PATENT DOCUMENTS

| | | | |
|---|---|---|---|
| 2,580,774 | 1/1952 | Helbig | 2/220 |
| 3,470,568 | 10/1969 | Belkin | 2/214 |

*Primary Examiner*—Werner H. Schroeder
*Assistant Examiner*—Doris L. Troutman
*Attorney, Agent, or Firm*—Browdy and Neimark

[57] ABSTRACT

A garment for the lower body, particularly for use by indigent or bedridden patients is disclosed. The garment comprises two lateral side panels of pentagonal configuration secured together along a central seam, and a central panel extending centrally from the side panel in generally T-configuration. The central panel is formed of two panels of pentagonal configuration secured together along a central seam, and secured along upper edges to lower edges of the two lateral side panels. The garment has a central fullness for fit in the crotch area when in use and the side panels cover the side and front side areas of the abdomen of the patient and the front panels cover the crotch portion and the frontal portion of the abdomen. Means preferably in the form of drawstrings are provided to secure side edges of the front panel to respective side edges of the side panels along lines of joinder frontally of the patient, with the lines of joinder extending from the waist of the patient to mid-thigh.

5 Claims, 7 Drawing Figures

MULTI-LAYERED GARMENT FOR THE LOWER BODY

FIELD OF THE INVENTION

The present invention relates to a garment for the lower body, and particularly to a garment to be worn by bedridden or indigent patients in hospitals, nursing homes, and other private homes where patients are cared for.

BACKGROUND OF THE INVENTION

Many indigent or bedridden patients are physically incapable of maintaining themselves hygienically clean, and in the case of patients who are totally or partially incontinent, the maintenance of hygienic cleanliness is a major consideration.

The only solution after a bowel or bladder movement is to remove the dirtied linen and garments worn by the patient and replace them with fresh sheets and clothing. In many cases, dirtying occurs quite frequently, and it is an extremely time consuming job for hospital attendants to continually maintain their numerous patients in a state of hygienic cleanliness. In addition to the actual labor involved, the responsibility of being an attendant for a patient is not an enviable one and it is becoming more and more difficult to secure individuals who are prepared to act in such as capacity. As a result, hospitals and the like are becoming increasingly short of capable personnel in patient hygienic cleanliness with the result that patients may be uncomfortable for lengthy periods of time to say nothing of the ever-present problem of infection.

Apart from the labor and hygienic problems involved, the constant washing and rewashing of bed linen and garments for bedridden patients places extremely demanding and expensive demands on the laundries, and of course necessitates having to have an extremely large number of sheets and linen and bed clothing available to satisfy the cyclic requirements involved. Laundry facilities of course necessitate the use of large quantities of water and strong cleaning agents with an ever increasing cost factor.

SUMMARY OF THE INVENTION

The present invention proposes to overcome the above difficulties by providing a garment or undergarment to be worn by bedridden patients enabling a hospital attendant to simply change the undergarment without the necessity of having to change the entire bed linen and clothing of the patient. By using the present garment, it is necessary simply to fold the garment together after it has been soiled and have it taken to the laundry for cleaning. By having to wash only the undergarment and not the complete bed linen and clothing results in substantial savings in labor and costs, not to mention the increased life expectancy of the bed linen.

The object of the invention is accomplished by providing an undergarment which extends substantially from the waist of the patient to positions midway down the thighs of the user to positively ensure the entrapment of solid or liquid excrement. In one construction, the waistband area and the thighbands may be provided with drawstring tying arrangements to ensure that any spoilage within the garment does not escape and soil adjacent bed linen.

This object is achieved by the present invention by providing a multi-layered garment for the lower body for use primarily by bedridden patients, at least the inner layer being moisture absorbent and at least one of the layers being moisture impermeable. The garment has two lateral side panels of pentagonal configuration secured together along a central seam which together enclose the rear, and sides of the patient from waist to mid-thigh when in use, and a central panel extending from the lateral side panels in generally T-configuration. The central portion is formed of two panels of pentagonal configuration secured together along a central seam, and secured along upper edges to lower edges of the two lateral side panels. The central portion covers the crotch area, and the insides of the legs of the patient down to mid-thigh, and the frontal portion of the abdomen to the waist. Means are provided to secure the central panel to side edges of the lateral side panels in partially overlapping relationship along lines of joinder which extend from waist to mid-thighs of the patient. The lateral side panels when opened are of a lateral dimension to receive a patient when rolled on his side and to provide a towelling and cleaning aid.

In preferred construction the lower edge of each lateral side panel and the adjacent lower edge of the central panel have a common draw cord or ribbon to be tied frontally to snugly engage around mid-thighs of the patient, and the upper edges of the lateral side panels have a common draw cord or ribbon to be tied to a draw cord or ribbon provided along the upper edge of the central panel frontally of the patient to snugly encircle the waist of the patient.

Canadian Pat. No. 147,873 of 1913 to V. Guinzburg describes Baby Pants or Diaper Covers which are front opening and including drawstrings to tighten the garment around the legs. The drawstrings, however, encircle the legs at the very top of the thighs adjacent the abdomen and such an arrangement is uncomfortable and constricting and can even be harmful by restricting circulation when the drawstrings are tightened to the extent to positively ensure entrapment of excrement.

The present invention overcomes the disadvantages discussed above by providing leg encircling portions which extend downwardly to substantially mid-thigh providing positive entrapment with comfortable fit.

One further problem which is encountered with chronically bedridden patients is that it is extremely difficult to move them to effect the changing of linen and clothing, for in many cases, their condition and health does not permit any movement at all or only minimun movement, and these patients may remain in their beds at all times. This necessitates rolling the patient from side to side to remove and replace bed linen and in addition to being harmful to the health of the patient requires still additional time by the attendant.

To overcome this problem, the present garment can easily be positioned on the patient and as quickly and easily removed after it has become soiled wih a minimum of movement and discomfort to the patient and in minimum time. This is accomplished by a garment having a front panel opening forwardly and downwardly between the legs of the patient, and side panels which open outwardly, whereby it is a simple matter for the attendant to position and remove the garment from the individual when the individual is in a position lying on his back. The garment is of sufficient thickness and strength to entrap and maintain all solid and liquid excrement, and is of a sufficient size to provide "towelling" for cleaning the patient when a soiled garment is being removed. By using the present invention in this latter respect, the use of additional towelling is of course minimized. In positioning and removing the garment on and from a patient minimum movements which must be endured by a patient are required.

BRIEF DESCRIPTION OF THE DRAWINGS

These and other objects of the present invention will become obvious from the following description in conjunction with the accompanying drawings wherein:

FIG. 1 illustrates the garment of the present invention in plan view when laid open on a bed or the like;

DESCRIPTION OF PREFERRED EMBODIMENTS

Figure 1:
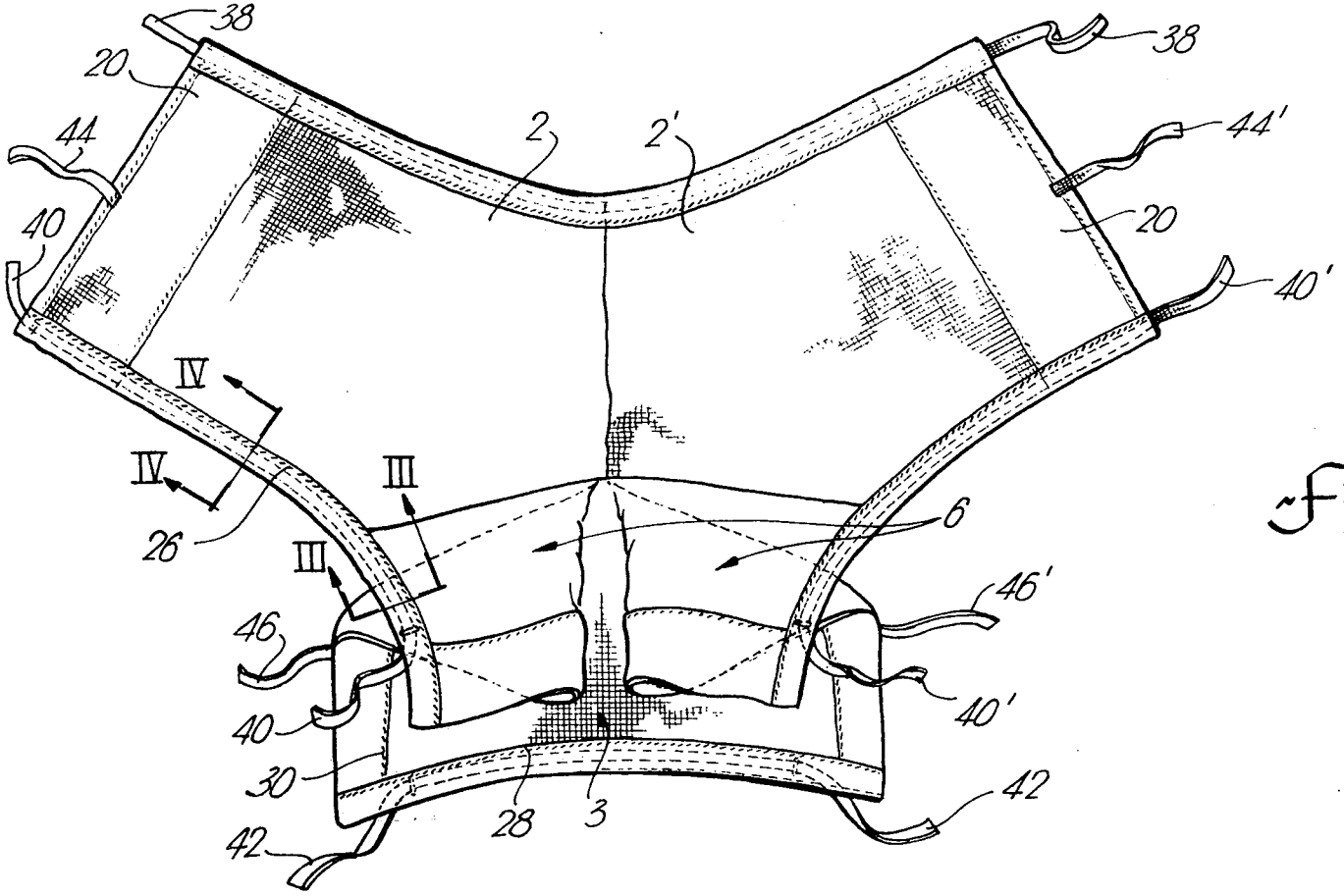

Reference will not be had to the accompanying drawings in detail wherein like reference numerals indicate like parts.

The preferred form of construction of the garment is shown in FIG. 1 and consists of side panels 2 and 2' and a lower panel 4. In FIG. 1, the material forming the panels is bunched or is in full in the crotch area as shown at 6 as this excess material is necessary to provide a full and proper fit on the patient when the garment is properly positioned thereon.

Figures 2, 3, 4, 7:
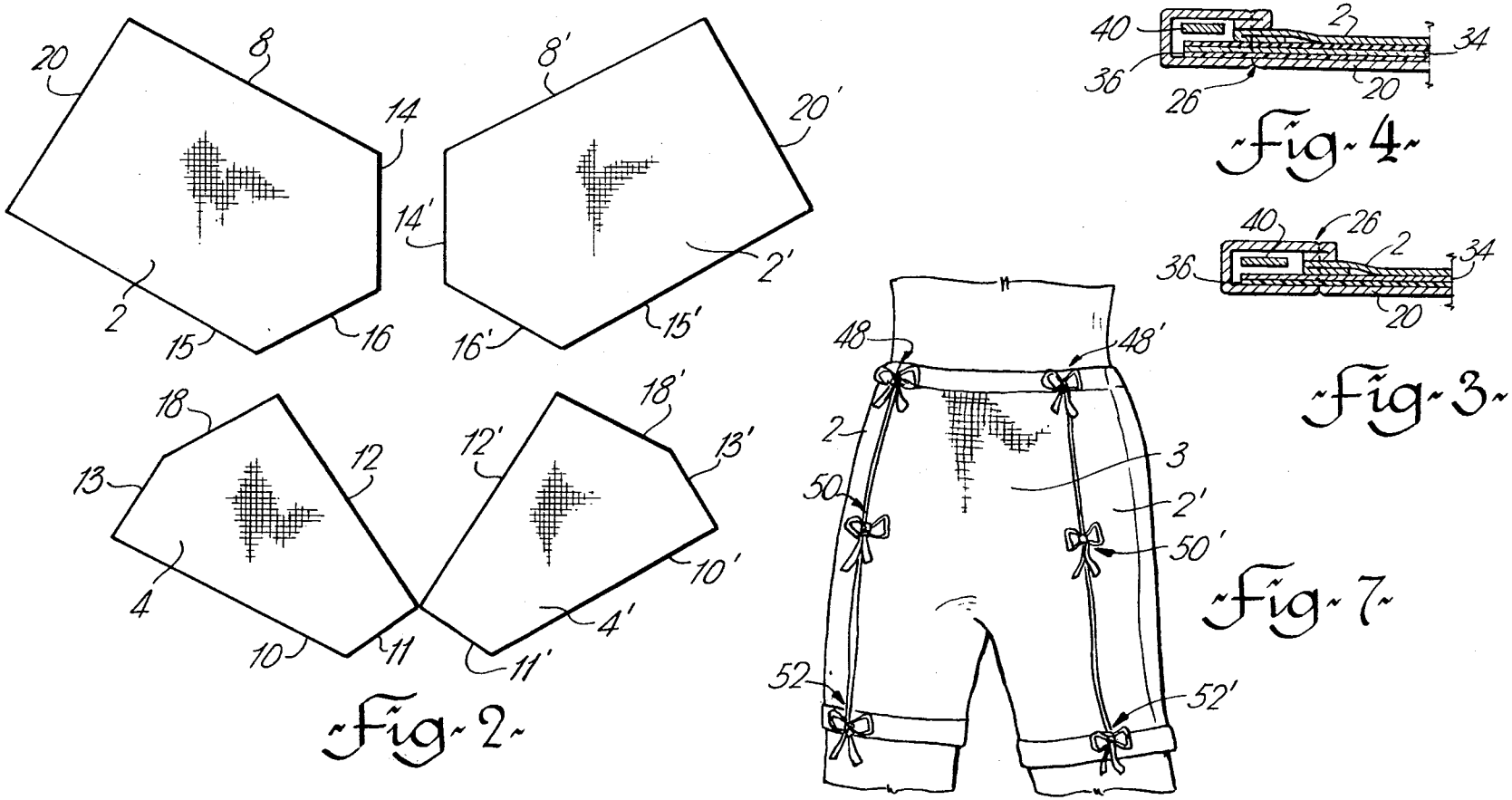
FIG. 2 illustrates four individual panal sections which may usefully be used in the construction of a garment according to the present invention.
FIG. 3 is a cross-sectional view taken along lines III—III of FIG. 1.
FIG. 4 is a side view taken along line IV—IV of FIG. 1.
FIG. 7 shows the garment in tied position on a patient.

The garment may if preferred be manufactured by sewing together four major panels as shown in FIG. 2. For convenience and in keeping with the numerals used in other drawings, the panels in FIG. 2 are numbered as being 2, 2', 4, and 4'. Edges 14 and 14' of panels 2 and 2' are sewn together, and edges 12 and 12' of panels 4 and 4' are sewn together and then edges 16 and 18, and 16' and 18' are sewn together to make the garment. Panels 4 and 4' together provide the front panel 3 mentioned above. The edges 8 and 8' of the panels 2 and 2' along with the edges 11 and 11' form the waistband area of the garment, while the edges 13 and 13' of the panels 4 and 4' along with edges 15 and 15' of panels 2 and 2' form thigh-encircling portions of the garment. To secure the garment to a patient a tie or draw cord or ribbon is provided in a hem along edges 8 and 8' for tying with a cord provided in a hem along edges 11 and 11'. A common draw cord is provided in a hem along edges 13 and 15, and a cord is provided in a hem along edges 13' and 15' for securing the garment around the mid-thighs of the patient. The showing in FIG. 2 is merely representative of one form of construction of the present garment arrangement, and the panels 2, 2', 4, and 4' may then be secured within an outer flannel or the like covering 20 which extends past the outer edges 20 and 20' of the panels 2 and 2' to provide for suitable fastening arrangements. The outer covering 20 is preferably constructed of four panels similar in configuration with panels 2, 2', 4, and 4' but somewhat larger size to enable suitable hemming and the provision of flap arrangements.

Figure 5:
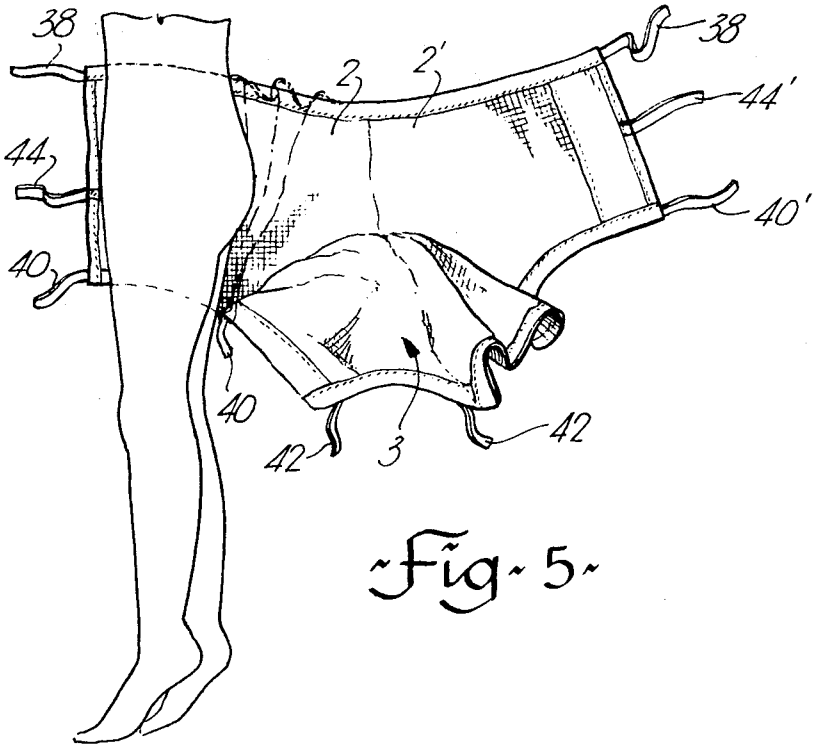
FIG. 5 illustrates in top view the position of the garment in respect of the body of a bedridden patient when the garment is either being positioned on the patient or removed.

The panels 2 and 2' may be sewn (see FIGS. 5 and 6) within the outer flannel or flannelette covering 20 by means of suitable seams 22, 24, 26 and 22', 24', 26'; and the front panel sections 4 and 4' may be sewn into position by suitable seams 28, 30, 32, and 28', 30, and 32' (see FIGS. 1 and 5).

The garment should be of material sufficiently durable to have a long life, and also to provide for absorbency, and preferably has a liquid impermeable layer to prevent passage of moisture through the garment. Although there are numerous ways in which this can be done, a suitable arrangement is shown in FIGS. 3 and 4, the former being a section along line III—III of FIG. 1 and the latter being a section along line IV—IV of FIG. 1. The inner panel 2 and the covering layer 20 may be of flannelette or layers of birdseye containing therebetween a suitable soaker layer 34 and a moisture barrier 36 which may be for example of rubberized pre-shrunk cotton or high temperature resistant vinyl cotton combination. A further layer or layers of soaker or moisture barrier material may be provided in certain areas of the garment as shown in FIG. 4.

The waist-engaging and thigh-engaging portions of the garment can be provided with a hollow hem to accommodate suitable drawstrings, and in the drawings, the drawstring for a portion of the waist portion is shown by the numeral 38, and the drawstrings for the thigh-engaging portions are shown by the numerals 40 and 40'. Drawstring 42 carried by the lower edge of the front panel ties fifth drawstring 38.

Figure 6:
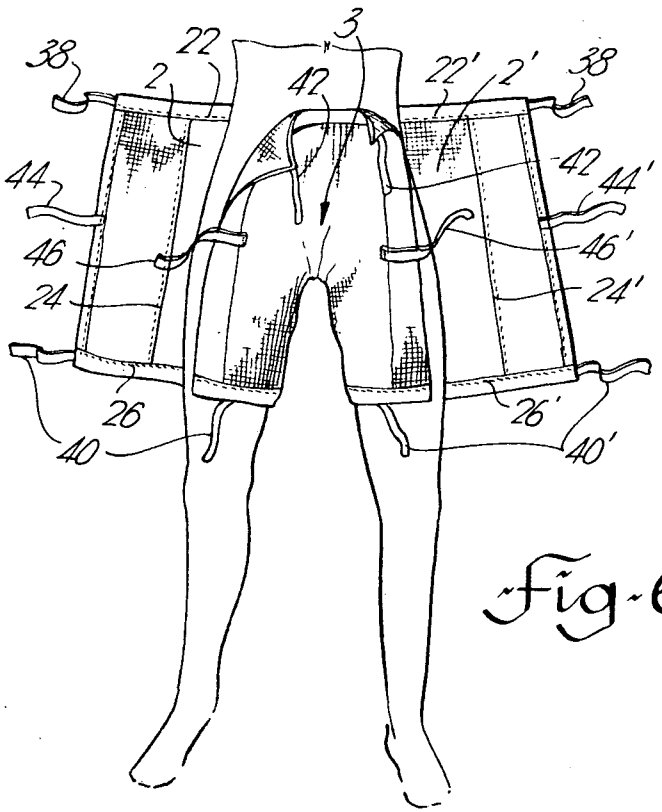
FIG. 6 is a top view of the patient when the patient has been rolled back onto the garment, and showing the front panel in raised position.

Intermediate drawstrings 44 and 44' are secured to the outer edges of the side panels between the upper and lower edges of the side panels between the upper and lower edges thereof and are adapted for securement to drawstrings 46 and 46' provided on the front panel of the garment as is clearly shown in FIG. 6.

The proper positioning of the garment on a patient is shown in FIG. 7.

One end of drawstring 38 ties with the respective end of drawstring 42 to form bow 48 (FIG. 7); drawing 44 ties with 46 to form bow 50; and the two ends of drawstring 40 tie together to form bow 52'. Similar securement at the other side of the garment is provided by bows 48' 50' and 52'.

When the garment has been dirtied an attendant simply unties the drawstring bows and lowers the front panel of the garment to a position between the legs of the patient. The patient is then rolled to one side of the other to a position generally indicated in FIG. 5. The front panel 3 of the garment is then folded upwardly to cover the dirt within the garment to remove it from view and also to ensure the elimination of any further distribution of excrement, as shown in FIG. 5. Once the patient is in the position shown in FIG. 5 the offside panel, which in FIG. 5 is 2' can then be used to towel the patient thoroughly. When the patient has been cleaned, the garment is then simply removed and passed to the laundry.

To position a new garment, one side panel 3 may simply be bunched against the individual in a manner as shown in broken lines in FIG. 5 and the patient then simply rolled back centrally onto the garment to a position as shown in FIG. 6. The front panel 3 is then raised and the side panels 2 and 2' brought into position at which time the drawstrings may be snugly tightened and tied to provide a snug and comfortable fit.

The use of drawstrings as described and shown in the drawings is preferred, both from the aspect of long life and in ease of laundering and also because they enable the garment to be used with patients of a certain general size. However, it will be appreciated that other fastening means, such as dome fasteners, slide fasteners, Velcro (Registered trade mark) could be used.

It is proposed that the garment be provided in a number of sizes ranging from small to large to suitably fit patients of varying size. Additionally, dome fasteners secured to a length of elastic tape could be usefully used in connection with the present garment.

For convenience in use, the flannelette or birdseye panels 2 and 2' may be of a color slightly different from the color of the panels 4 and 4' to simplify the use and ease of positioning of the garment on a patient.

I claim:

1. A multi-layered garment for the lower body for use primarily by bedridden patients, at least an inner layer thereof being moisture absorbent and at least one layer thereof being moisture impermeable, the garment comprising:

two lateral side panels of pentagonal configuration secured together by a central seam and which are together to cover the rear, at least part of the abdomen, and sides of a user from waist to mid-thigh when worn, a central panel extending from said lateral side panel in generally T-configuration, said central panel being formed of two panels of pentagonal configuration secured together along a central seam, and being secured along upper edges thereof to lower edges of said two lateral side panels, said central portion being adapted to cover the crotch area, and the insides of the legs of the user down to mid-thigh, and the frontal portion of his abdomen to his waist, and means unfixedly to secure said central panel to side edges of said lateral side panels in partially overlapping relationship along spaced apart lines of joinder which extend along the frontal portion of the abdomen of the user from his waist to mid-thighs, said lateral side panels when opened being of a lateral dimension to receive the user when rolled on his side and to provide a towelling and cleaning aid.

2. A garment according to claim 1, wherein the lower edge of each said lateral side panel and the adjacent lower edge of said central panel having a common draw cord or ribbon to be tied frontally to snugly engage around mid-thighs of the user, and wherein the upper edges of said lateral side panels having a common draw cord and ribbon to be tied to a draw cord or ribbon provided along the upper edge of said central panel frontally of the user to snugly encircle the waist of the user.

3. A garment according to claim 1, wherein said means unfixedly to secure said side edges of said lateral side panels to said central panel consist of tie cords.

4. A garment according to claim 1, including inner and outer layers of flannelette or birdseye material and soaker and moisture impervious layers therebetween.

5. A garment according to claim 1, including means for unfixedly securing lower edges of each said lateral side panel and respective adjacent lower edges of said central panel around mid-thighs of the user.

* * * * *